United States Patent [19]

Marsh

[11] Patent Number: 4,493,188

[45] Date of Patent: Jan. 15, 1985

[54] DRIVE TRANSMISSION MEANS

[76] Inventor: Mervyn R. Marsh, 118 Star St., Carlisle W.A., Australia, 6101

[21] Appl. No.: 287,748

[22] PCT Filed: Dec. 10, 1980

[86] PCT No.: PCT/AU80/00107

§ 371 Date: Jul. 31, 1981

§ 102(e) Date: Jul. 31, 1981

[87] PCT Pub. No.: WO81/01729

PCT Pub. Date: Jun. 25, 1981

[30] Foreign Application Priority Data

Dec. 10, 1979 [AU] Australia ..... PE1673

[51] Int. Cl.[3] ..... F16D 31/04

[52] U.S. Cl. ..... 60/468; 417/284; 418/191

[58] Field of Search ..... 60/386, 402, 433, 468, 60/489, 494; 417/283, 284; 418/191

[56] References Cited

U.S. PATENT DOCUMENTS

| | | | |
|---|---|---|---|
| 2,264,375 | 12/1941 | Hill et al. | 60/468 X |
| 2,513,304 | 7/1950 | Fraser | 60/468 X |
| 2,936,716 | 5/1960 | Looker . | |
| 4,025,239 | 5/1977 | Richardson, Jr. et al. . | |
| 4,059,368 | 11/1977 | McGahan et al. . | |

FOREIGN PATENT DOCUMENTS

| | | |
|---|---|---|
| 235035 | 12/1959 | Australia . |
| 286044 | 3/1966 | Australia . |
| 459524 | 4/1974 | Australia . |
| 2339872 | 2/1975 | Fed. Rep. of Germany . |
| WO80/01400 | 7/1980 | PCT Int'l Appl. . |
| 1418266 | 12/1975 | United Kingdom . |

*Primary Examiner*—Michael Koczo

*Attorney, Agent, or Firm*—Pennie & Edmonds

[57] ABSTRACT

This invention provides apparatus for use in a drive transmission system comprising a pump adapted to perform work on a medium and means repetitively and automatically to unload the pump. When connected with a flywheel driven by a prime mover an embodiment alternately performs work and then is unloaded to permit acceleration of the flywheel. In use in a driven transmission system there is provided a flywheel driven by an engine, a pump driven by the flywheel, powered by the pump, and means repetitively to unload the pump permitting the engine to accelerate the flywheel and compensation means to power the hydraulic motor while the pump is unloaded. The pump is preferably a rotary positive displacement pump having relief galleries eliminating the seal between pumping elements driving each cycle.

7 Claims, 7 Drawing Figures

DRIVE TRANSMISSION MEANS

TECHNICAL FIELD

This invention relates to means for transmitting power from a prime mover to a load.

In transmitting power from a prime mover to a load provision must commonly be made for variation in load demand. Frequently the prime mover is incapable of responding to such variation by increasing energy output with desired rapidity or such response can be achieved only by inefficient operation of the prime mover.

BACKGROUND ART

An example is a motor vehicle having an internal combustion engine as prime mover and propelling the vehicle as load.

The vehicle is provided with a gear box between the engine and the load to provide torque conversion enabling the engine to run in a power output range and at a speed of revolution range in which the engine operates efficiently, notwithstanding load variation, for example when the vehicle travels up a hill.

Nevertheless the engine cannot operate at its optimum efficiency under all conditions because the gear box provides for change of gear ratios in discrete steps.

Moreover rapid acceleration within any gear ratio can only be achieved by carburetting a fuel rich mixture which is inefficiently utilised by the engine and is wasteful of fuel. Alternatively the engine may be operated at optimum fuel economy but at the expense of slower acceleration.

Embodiments of the present invention provide means of operating such a motor at a more nearly constant fuel consumption and at close to optimum engine efficiency, while permitting periods of vehicle acceleration at a rate which is independent of engine speed of revolution.

Furthermore embodiments of the invention provide a more or less continuously variable torque conversion in transmission of power from a prime mover to a load and may be used in substitution for a gear box.

In some embodiments it is possible to deliver more torque to the load than could instantaneously be provided by the prime mover.

According to a first aspect the invention consists in apparatus for use in a drive transmission system comprising:

a pump adapted to be driven to perform work on a medium, and means repetitively and automatically to unload the pump.

According to a second aspect the invention consists in apparatus for use in a driven transmission system comprising:

a flywheel driven by a prime mover a pump driven by the flywheel to perform work on a medium and means repetitively to unload the pump whereby to permit acceleration of the flywheel.

According to a third aspect the invention consists in drive transmission means for transmitting power from a prime mover to a load comprising:

a flywheel driven by the prime mover, a pump driven by the flywheel, a hydraulic motor powered by the pump, means repetitively to unload the pump thereby permitting the prime mover repetitively to accelerate the flywheel; and compensation means to power the hydraulic motor while said pump is unloaded.

According to preferred embodiments of the invention the pump is a positive displacement pump, and more preferably a rotary positive displacement pump, provided with relief galleries which eliminate the seal between pumping elements during a part of each stroke or revolution, whereby the pump is repetitively unloaded.

By way of example only various embodiments of the invention will now be described with reference to the accompanying drawings, in which.

Figure 1:
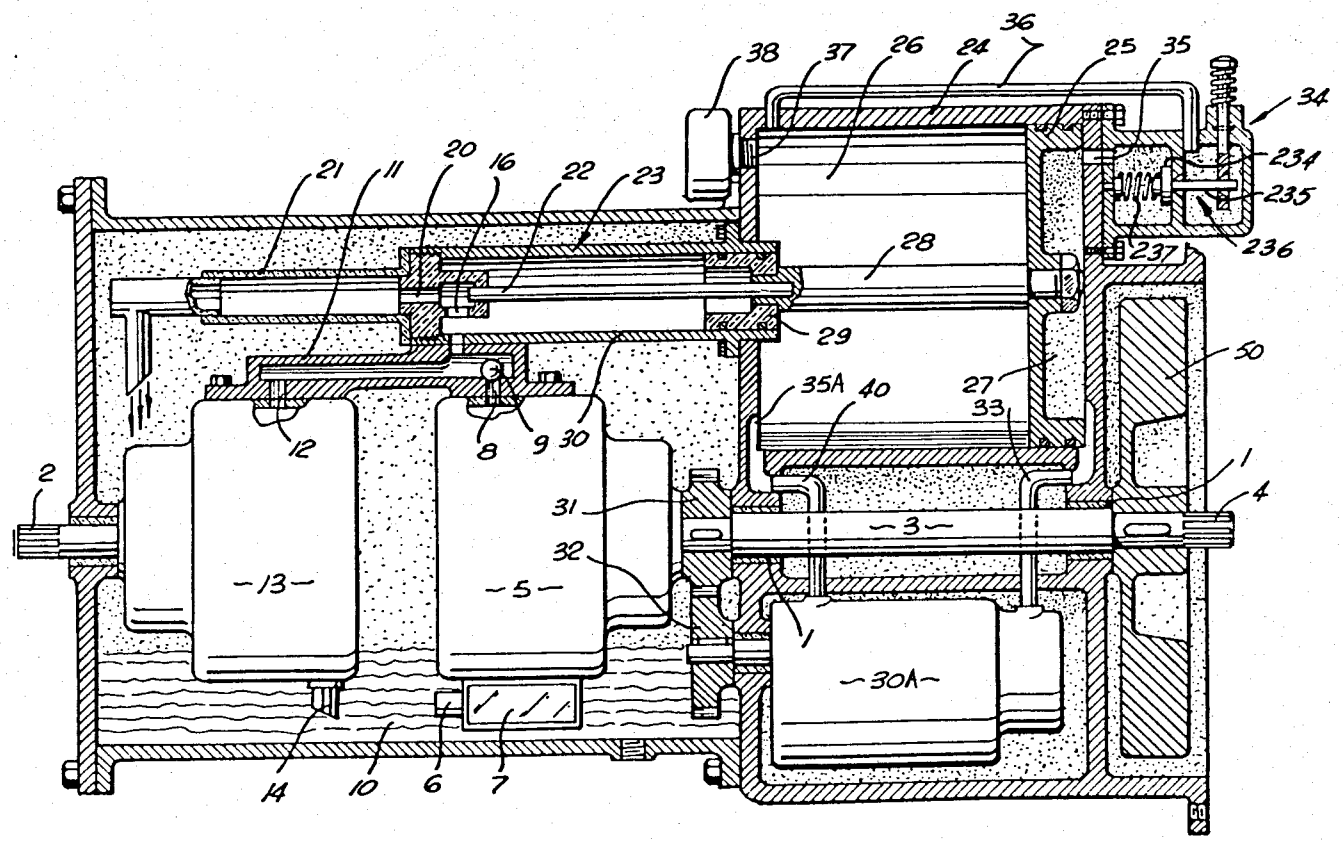
FIG. 1 is a schematic diagram showing a drive transmission system according to the invention.

With reference to FIG. 1, there is shown schematically an embodiment of drive transmission means according to the invention. The apparatus is intended to deliver power from a conventional engine (not shown) from which torque is to be transmitted to an output shaft 2 for driving a load (not shown in FIG. 1).

A main shaft 3 supported by bearings 1 is coupled at one end for example by inter-engageable splines 4 with the engine whereby main shaft 3 may be driven in axial rotation. A pump, indicated generally at 5, having an oil inlet indicated at 6 fitted with a filter 7, and having an outlet 8 fitted with a non-return valve 9, is driven from main shaft 3.

In the present example pump 5 is a rotary positive displacement pump of a type to be described in more detail hereinafter which is provided internally with means, also to be described, whereby the pump is repetitively unloaded. Specifically the pump is loaded during a first and third quarter revolution of main shaft 3 producing a high pressure at pump port 8 while during a second and a fourth quarter revolution of main shaft 3 the pump is unloaded. That is to say, pump 5 utilises power supplied to it during two quarter revolutions to raise oil to high pressure while during the remaining two quarter revolutions the pump performs substantially no work and is freely rotatable.

Pump 5 is mounted in a sump 10 and the high pressure pump outlet port 8 communicates via a high pressure manifold 11 with the inlet side 12 of a hydraulic motor indicated generally at 13 whereby output shaft 2 is driven in rotation. Oil from the outlet side 14 of motor 13 is returned to sump 10. A valve may be provided whereby the direction of flow of hydraulic fluid from manifold 11 through motor 13 may be reversed permitting the motor and consequently output shaft 2 to be driven in clockwise or anticlockwise rotation.

The torque delivered by motor 13 is controlled by the bleed of fluid from manifold 11 via a valve having a valve orifice 20 communicating with a bypass return line 21 which returns oil to sump 10. The ratio of the amount of oil returning to the sump by motor 13 to the amount bypassing motor 13 through return line 21, that is to say the pressure of oil supplied to motor 13, is controlled by valve rod 22 which is actuatable to open or close valve orifice 20.

High pressure oil manifold 11 also communicates with a high pressure oil stabiliser indicated generally at 23. Oil stabiliser 23 comprises a large diameter control air cylinder 24 fitted with an air piston 25 movable slidably therein and providing a seal with the walls of cylinder 24 so that air piston 25 divides cylinder 24 into a low pressure side 26 and a high pressure side 27. A piston rod 28 is connected at one end to the low pressure side of air piston 25 and, at the other end, to a small diameter oil piston 29 slidable within oil cylinder 30 and providing a seal therewith. Valve rod 22 has one end connected on the side of oil piston 29 opposite the side of connection of piston rod 28 thereto and is co-axial with piston rod 28. The other end of valve rod 22 is slidable in a valve seating so as to control oil flow from manifold 11 via valve inlet 16 and valve orifice 20 to oil bypass return pipe 21 which has a diameter greater than that of valve rod 22.

A compressor 30A, in the present example driven by inter-engaging gears 31 and 32 from main shaft 3 provides compressed air via a line 33 to the high pressure side 27 of air piston 25. The air pressure in the high pressure side of air piston 25, that is to say in the cylinder head, is controlled by valve means indicated generally at 34 connected between orifice 35 of the cylinder head and an air return line 36 communicating with the low pressure side 26. The low pressure side 26 is provided with an air inlet 37 having a filter 38 communicating with the atmosphere and an outlet 35A communicating via air line 40 with the inlet side of compressor 30 whereby air is provided to compressor 30. Valve means 34 includes a valve head 234 having a stem 235 extending through a valve seat orifice 236. Valve head 234 is biased toward a seated position by a spring 237, and the passage of air through the orifice may be controlled by displacing valve head 234 by any conventional means, for example a lever acting on valve stem 235.

Valve rod 22 is arranged so that when air pressure on the high pressure side of air piston 25 is at atmospheric pressure and oil manifold 11 is pressurised, oil pressure in manifold 11 drives oil piston 29 and air piston 28 to fully extended positions in which valve rod 22 opens valve orifice 20 fully, thereby permitting flow of oil to bypass line 21. Increase of air pressure can be used to drive valve rod 22 progressively to close off oil bypass of motor 13 at orifice 20, or close it completely.

A flywheel 50 is fixedly mounted to shaft 3.

In operation the engine may be operated for example at a constant throttle and thereby turns shaft 3 and flywheel 50. During the first and third quarter revolution of shaft 3 pump 5 is driven, supplying high pressure oil to manifold 11. A proportion of the oil is used to drive hydraulic motor 13 and the balance is returned via valve orifice 20 and bypass 21 to sump 10. The pressure of oil admitted to motor 13, and hence the torque delivered by the motor, may be varied according to the torque requirements at output shaft 2 by control of air pressure at the high pressure side of piston 25 by means of valve 34 and thereby control of valve rod 22.

During the second and fourth quarter cycle of pump 5 no appreciable work is performed by the pump. During those periods the output of the engine therefore accelerates flywheel 50 storing energy as kinetic energy in the flywheel. During such periods the reservoir of oil contained in high pressure oil cylinder 30 is driven by air pressure acting on air piston 25 via piston rod 28 and oil piston 29 to drive motor 13 and at the same time closing the bypass of oil via valve orifice 20, thereby acting to even out the pressure fluctuations in the high pressure oil manifold 11 and to provide a more or less constant average oil pressure to motor 13.

It will be apparent that the torque transmitted from the couple of engine and flywheel 50 to shaft 2 can be varied continuously and that this is achieved by simple control means. Moreover more energy can be supplied for a short period to drive shaft 2 than is supplied during that short period by the engine, the additional energy withdrawn from the kinetic energy stored in the flywheel. In that event the flywheel is decelerated but can be again accelerated during following second and fourth quarter revolutions of shaft 3 occurring during periods when energy demand at output shaft 2 is less than the average supplied by the engine. It is therefore possible to drive the engine for example at optimum efficiency with respect to fuel consumption and to store the energy produced in flywheel 50. If energy supplied to the load exactly equals the output of the motor (ignoring losses which are minor) the flywheel will on average be neither accelerated nor decelerated. If the energy supplied to the load during a period is less than that provided on average by the motor, the surplus will be stored in the flywheel by acceleration thereof, and the stored energy will be available for subsequent consumption at a rate greater than the average output of the motor by deceleration of the flywheel. The system as a whole therefore performs at an optimum efficiency notwithstanding variations in load demand.

Figure 2:
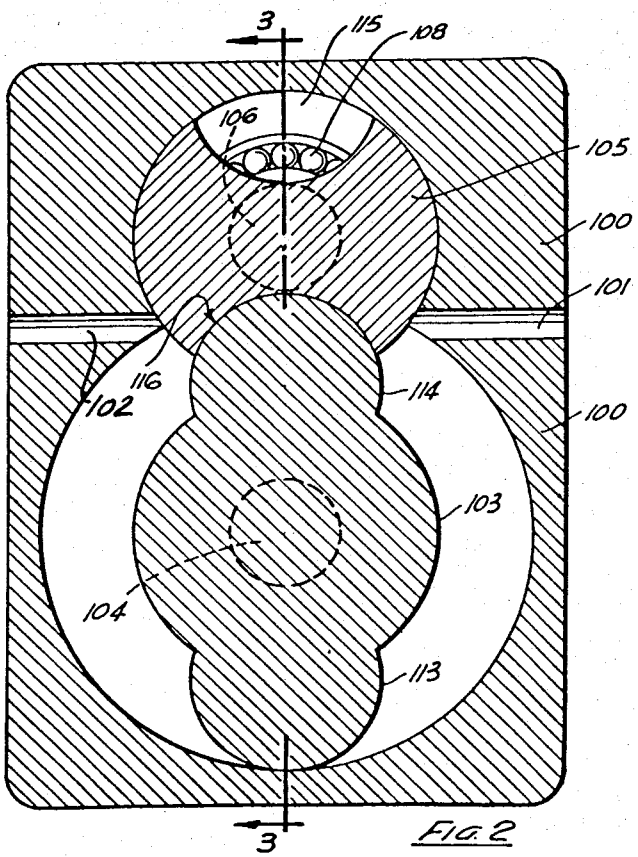
FIG. 2 shows in sectional elevation an embodiment of apparatus useful as a hydraulic motor or pump in drive transmission systems of the invention, taken along line 2—2, of FIG. 3.
Figure 3:
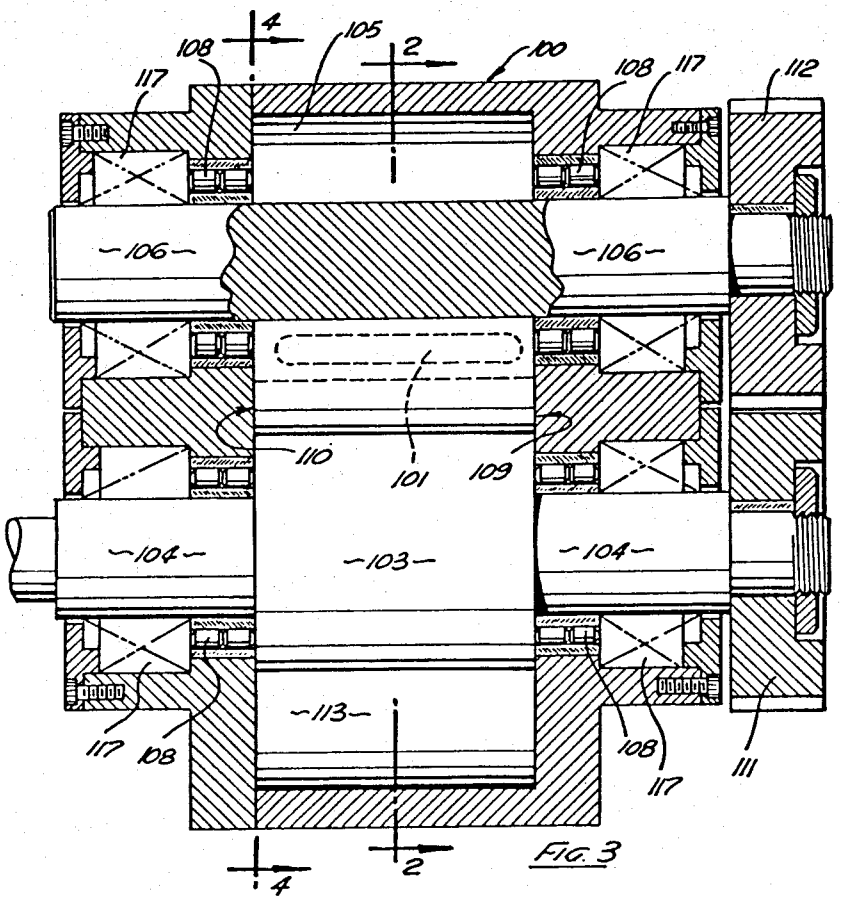
FIG. 3 shows a part sectional view of the apparatus taken along line 3—3 of FIG. 2.
Figure 4:
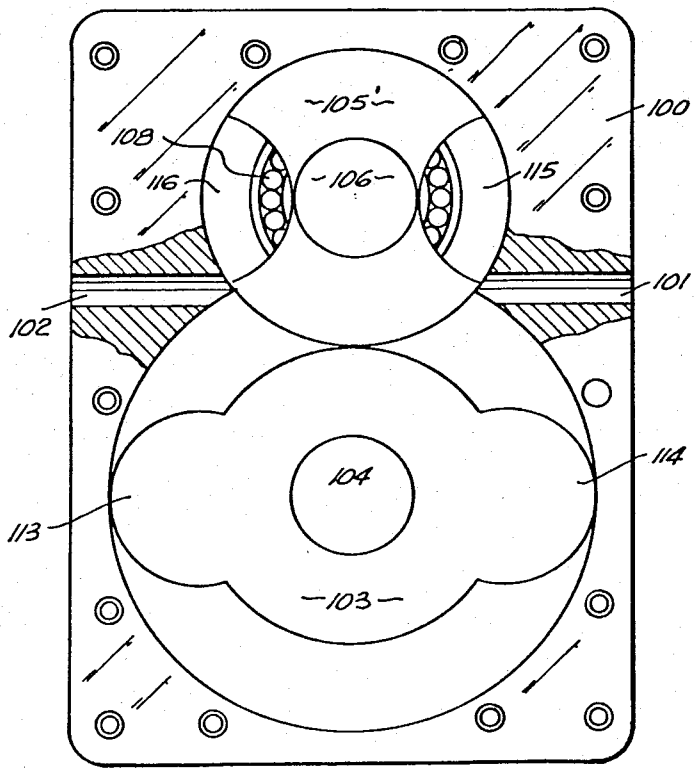
FIG. 4 shows in part section the apparatus taken along line 4—4 of FIG. 2 with its rotors at a different position.

With reference to FIGS. 2, 3 and 4 there is now described an embodiment of an apparatus which may be used as a hydraulic pump, as the hydraulic motor 13 of FIG. 1 or as the air compressor 30A of FIG. 1. For simplicity its operation will be described first with reference to its use as a hydraulic pump.

The pump comprises a housing 100 having a first port 101 which in the present example is an inlet port and a second port 102 which in the present example is an outlet port, a first rotor 103 fixedly mounted to a shaft 104 and a second rotor 105 fixedly mounted to a second shaft 106.

Shafts 104 and 106 are parallel and are supported by bearings 108 mounted to parallel end walls 109 and 110 of housing 100.

Shafts 104 and 106 project through end wall 109, high pressure oil seals 117 being provided to prevent escape of oil from the housing interior, and shaft 106 is driven synchronously with, but in opposite sense to, shaft 104 by means of intermeshing gears 111 and 112 mounted respectively to the shafts 104 and 106 externally of the pump and adjacent wall 109.

Rotors 103 and 105 are of generally cylindrical shape and equal radii and are effectively in rolling line contact. However rotor 103 is provided with two protruding lobes 113 and 114 each of which in cross-section is shaped in the arc of a circle centred on the circumference of rotor 103, at diametrically opposite points thereof, and is adapted during rotation of the rotor to sweep fluid admitted at the inlet through a volume defined between rotor 103 and housing 100 to port 102.

For this purpose the peripheries of lobes 113 and 114 are in close tolerance clearance with housing 100 between port 101 and port 102 in the direction of rotation of rotor 103.

Rotor 105 is provided with depressions 115 and 116 which in cross-section are shaped in the arc of a circle of the same radius as that of lobes 113 and 114 and centred on the circumference of rotor 105. That is to say depressions 115 and 116 of rotor 105 correspond in cross-section to the protrusion of lobes 113 and 114.

Moreover the synchronisation of the two rotors during rotation is such that lobes 113 and 114 intermesh periodically with the depressions 115 and 116. At rotary angle of maximum intermesh the lobes are in contact with or at close clearance tolerance from the depression surface of rotor 105 over a cross-section corresponding to an arc, as shown in FIG. 2. Inlet port 101 and outlet port 102 are centred on the chord of intersection of the circles of pump housing 100 at opposite ends of the chord. For preference at least the outlet port is slot-shaped and extends longitudinally in the axial direction.

In operation of the apparatus of FIGS. 2 to 4 as a pump, fluid is admitted at port 101 and swept in the direction of port 102 by driven rotation of shaft 103. The fluid is substantially prevented from returning to the inlet port side by the seal formed between rotors 103 and 105 at the line of contact and is therefore expelled from port 102.

By virtue of synchronisation of the rotors, lobes 113 and 114 may pass through the seal line while maintaining the seal. In addition some fluid from inlet 101 is carried in depressions of rotor 105 towards exit port 102 where the progressive engagement of a lobe with the depression positively displaces the fluid carried from the depression ejecting the fluid in a trailing direction, and expelling it from the exit port.

When used as an air pump the apparatus may be submerged in oil within a sealed sump. Filtered air is provided from outside the sump at atmospheric pressure via an air inlet line to the pump inlet. Air is ejected from the pump outlet into the surrounding oil and passes to a space above the oil level. A high pressure air outlet connection communicates with the space. For preference a baffle is provided in the oil above the pump outlet port and further baffles may be provided to prevent oil from being entrained with high pressure air drawn from the sump outlet connection.

Oil enters the pump from the pump outlet port at least when the pump is not operated and, it is thought, during certain portions of its rotary cycle, thereby providing lubrication of the pump.

When used as a hydraulic motor a hydraulic fluid under pressure may be admitted at one port whereby the rotors are driven and spent fluid at a lower pressure exits from the other port. In this case shaft 104 or 106 is extended externally of housing 100 to provide a drive shaft.

There will now be described with reference to FIGS. 5 to 7 apparatus suitable for use as pump 5 of FIG. 1.

Figure 7:
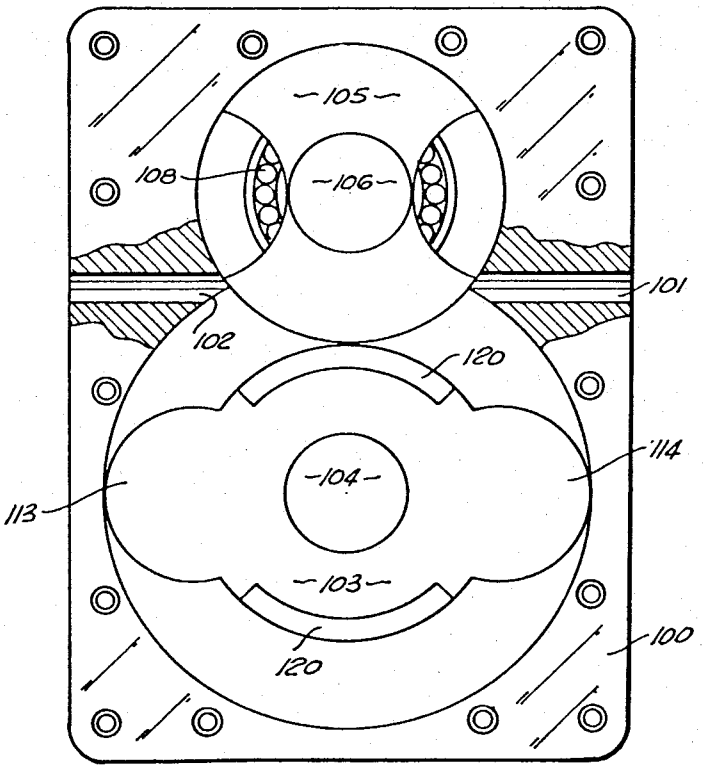
FIGS. 5 to 7 show an embodiment of a pump having means repetitively to unload the pump.
Figure 5:
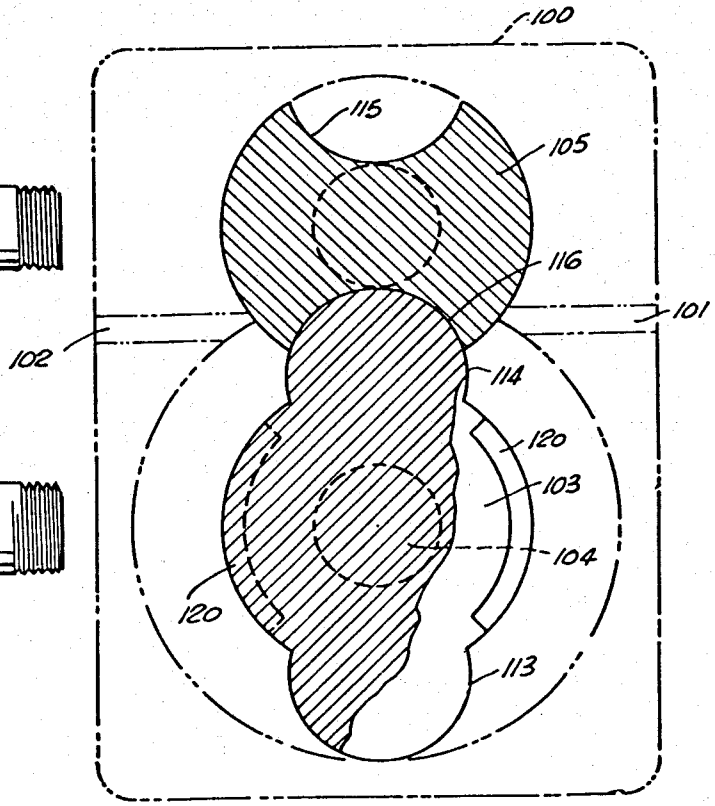
Figure 6:
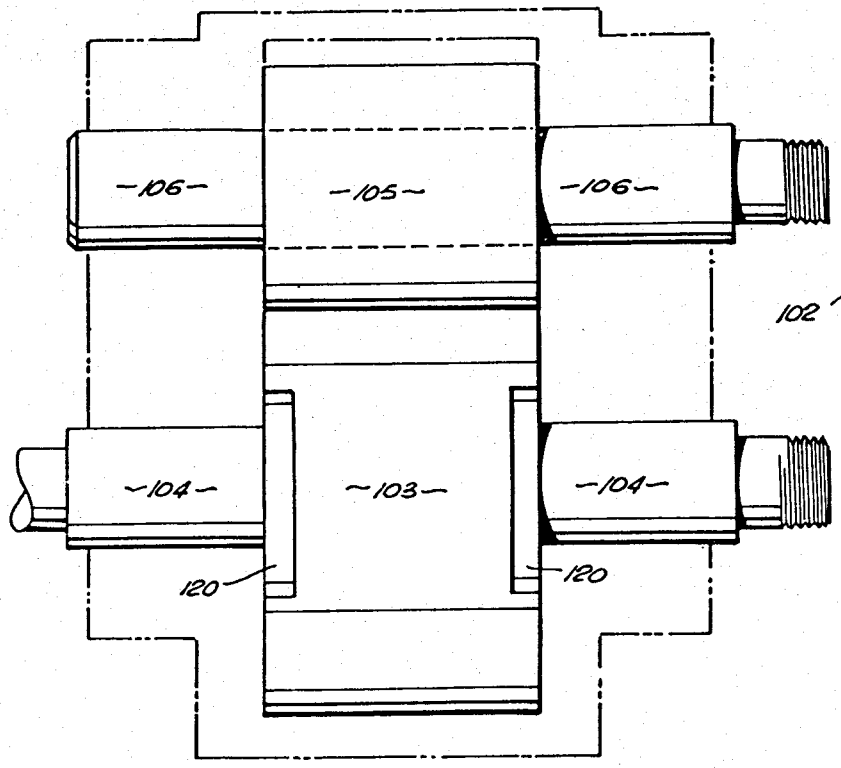

The pump is in most respects similar to the apparatus shown in FIGS. 2–4 and the same numerals are used in FIGS. 5 to 7 to identify parts corresponding to those of FIGS. 2–4.

An important difference of the present pump from that described in FIGS. 2 to 4 is the provision of means which periodically break the pump seal and thereby relieve the load on the pump.

In the embodiment of FIGS. 5 to 7 there are provided 4 circumferential pressure relief recesses 120 extending over an arc subtending an angle of 90° at the rotor axis and each located along an edge of the rotor cylindrical portion and intermediate the lobes.

In the present example the rotor has a width in the axial direction of 90 mm and the recesses have a radial depth of 10 mm and an axial width of 10 mm.

The effect of pressure relief recesses 120 is that during operation of the apparatus as a pump in the manner described in relation to the apparatus of FIGS. 2 to 4, the pump of FIGS. 5 to 7 provides positive displacement during a first and third quarter cycle of rotor 103 while during a second and fourth quarter cycle the seal between inlet and outlet sides of the pump is broken by virtue of communication therebetween via pressure relief recesses 120 as shown in FIG. 7.

Thus during the second and fourth quarter cycles substantially no work is performed by the pump of FIGS. 5 to 7.

During the first and third quarter cycles commencing with reformation of the seal the volume contained between the line of seal at rotors 103 and 105, outlet port 102, the leading surface of a lobe approaching the outlet port, and the surface of rotor 105 rapidly contracts, ejecting fluid contained in that volume and in the corresponding depression of rotor 105 from the outlet at high pressure.

The pump thus produces a pulsating output achieving high peak pressures during a first and third quarter cycle and is freely rotatable during a second and fourth quarter cycle.

In other embodiments, apparatus according to the invention may be adapted to replace the clutch and gear box of a vehicle by being mounted in the transmission housing of the vehicle in substitution for the clutch and gear box. In that event, the transmission output shaft is connected, for example by a spline coupling, to a universal joint connected to the vehicle tail shaft and thereby to the load, in this case the vehicle, while the input shaft is connected via a splined coupling to the flywheel of the vehicle engine. With reference to FIG. 1, first shaft 3 is then supported by bearings from the transmission housing of the vehicle. Pump 5 and motor 13 are housed within the transmission housing which acts as an oil sump. Main shaft 3 is in fact an extension of shaft 104 of pump 5. The external synchronising gears 111 and 112 of pump 5 and motor 13 are lubricated by the oil in the sump.

In other embodiments of the invention, the prime mover may be of any kind, for example, an internal combustion engine, electric motor, a waterwheel or a man-powered pedal arrangement.

The flywheel dimensions and weight should be selected having regard to the power output of the motor, the power requirements of the load and the storage capacity required.

It will be understood that while use of pumps as described are highly preferred, they are not essential for performance of the invention.

Any pump may be used if means are provided for relieving the load repetitively so that the flywheel can be accelerated.

For example, a gear pump could be employed having grooves cut in certain gear teeth.

Alternatively a reciprocating piston pump can be provided with longitudinal grooves along the cylinder wall over a part of the piston stroke.

Moreover means external of the pump may be used to relieve pump load. For example, depending on the type of pump chosen, a pump may be arranged with a bypass line connecting the outlet to the inlet, the bypass line having a repetitively operated valve. The valve could be a rotary valve controlled from the main drive shaft or could for example be a solenoid valve electrically opened and closed repetitively.

However it is essential that the pump be relieved by some means to permit energy storage in the flywheel. Furthermore it is not essential that the periods of no load be of equal duration with the periods of load.

The use of the embodiment of motor and pump described has the advantages of simplicity and uniformity of design varying only in scale and therefore units of differing scale may easily be combined in a modular manner to meet the particular design requirements of a transmission system.

Moreover the adoption of the pump to provide means of repetitively unloading it is achieved with simplicity.

It will be understood that similar pumps having a fewer or greater number of lobes and having lobes of different diameter relative to the rotor, or having other profiles fall within the scope of the invention.

I claim:

1. Drive transmission means for transmitting power from a prime-mover to a load, comprising:

a flywheel driven by the prime-mover, a pump drivingly connected to the flywheel to place a hydraulic medium under pressure, a hydraulic motor powered by said medium from the pump, means repetitively, and independently of the level of said pressure, to unload the pump thereby permitting the prime-mover repetitively to accelerate the flywheel; and compensation means drivingly connected to the flywheel to power the hydraulic motor while said pump is unloaded.

2. Apparatus according to claim 1 wherein the pump is a positive displacement pump having at least two pumping elements forming a seal, and further provided with one or more relief galleries which eliminate said seal between said pumping elements during a part of each repetitive stroke or revolution, whereby the pump is repetitively unloaded.

3. Apparatus according to claim 1 wherein the pump comprises:

a housing having an inlet port and an outlet port, a rotor mounted for axial rotation within said housing and adapted positively and cyclically to displace said medium admitted at said inlet port towards said outlet port during a first part of a rotor cycle, a rotary seal cooperating with said rotor for preventing passage of said medium from said outlet port towards said inlet port during said first part of the rotor cycle, and a relief gallery in at least one of said rotary seal and the rotor, said gallery communicating between the outlet and the inlet during a second part of said cycle whereby the pump is repetitively unloaded.

4. Apparatus according to claim 1 wherein the compensation means comprises:

a first reservoir for receiving said medium under pressure which is expelled from the pump, and means for delivering said medium under pressure from the first reservoir to the hydraulic motor while the pump is unloaded.

5. Apparatus according to claim 4 wherein said means for delivery of medium from the first reservoir to the hydraulic motor includes means for controlling the pressure of said delivery in response to at least one of the output shaft speed or torque of the hydraulic motor.

6. Apparatus according to claim 4 or claim 5 wherein said medium is delivered under pressure to the hydraulic motor from the first reservoir while the pump is unloaded, said pressure being imposed by piston means responsive to a second medium under pressure.

7. Apparatus according to claim 6 wherein said compensation means includes a compressor drivingly connected to the flywheel for compressing said second medium.

* * * * *